United States Patent [19]

Bottoms et al.

[11] 3,964,885

[45] June 22, 1976

[54] CENTRIFUGAL PUMPS

[75] Inventors: Harry Simister Bottoms, Solihull; Leslie Holliday, Blackburn, both of England

[73] Assignee: Joseph Lucas (Industries) Limited, Birmingham, England

[22] Filed: June 18, 1974

[21] Appl. No.: 480,595

[52] U.S. Cl. ..... 55/203; 55/406; 417/356

[51] Int. Cl.[2] ..... B01D 47/00; B01D 53/22; F04B 17/00; F04B 35/04

[58] Field of Search ..... 417/356, 355, 199 A; 415/215, 143; 55/406, 203; 233/27, 46, 47 R

[56] References Cited

UNITED STATES PATENTS

| | | | |
|---|---|---|---|
| 1,914,382 | 6/1933 | Osterberg | 417/355 |
| 2,850,984 | 9/1958 | Shiley | 55/407 |
| 3,278,170 | 10/1966 | Moritz | 415/143 |
| 3,723,028 | 3/1973 | Bottoms et al. | 415/215 |

FOREIGN PATENTS OR APPLICATIONS

| | | | |
|---|---|---|---|
| 2,311,456 | 9/1973 | Germany | 55/203 |
| 716,382 | 10/1954 | United Kingdom | 55/406 |

*Primary Examiner*—Carlton R. Croyle
*Assistant Examiner*—Richard E. Gluck
*Attorney, Agent, or Firm*—Finnegan, Henderson, Farabow & Garrett

[57] ABSTRACT

A centrifugal pump has a rotor with two aligned frusto-conical passages, between the larger ends of which is a centrifugal impeller. The lower, smaller end of one of the passages forms a pump inlet. Frusto-conical funnels within the passages act to separate a vapor core from a liquid which is ejected by the impeller. The vapor is ejected from the smaller end of the other passage. A deflector and vanes within the rotor assist ejection of the vapor.

7 Claims, 3 Drawing Figures

CENTRIFUGAL PUMPS

This invention relates to pumps and has as an object to provide a pump in a convenient form.

According to the invention a pump comprises a rotor defining a pair of aligned frusto-conical chambers and a centrifugal impeller arrangement between the said chambers, the larger diameter of each chamber being adjacent the impeller arrangement and the smaller diameter of one of the chambers defining an inlet for the pump, a first hollow frusto-conical member having a through passage and mounted coaxially within the other of the chambers so as to define an annular-section space therein, the smaller diameter of the said first member being directed towards the impeller arrangement and the larger diameter of said first member engaging the smaller diameter of the said other chamber, a plurality of holes in the wall of said first member, a stator surrounding the rotor and a passage within the stator communicating with the impeller arrangement and with an outlet for the pump.

Examples of pumps according to the invention will now be described with reference to FIGS. 1 to 3 which show alternative forms of pump.

Figure 1:
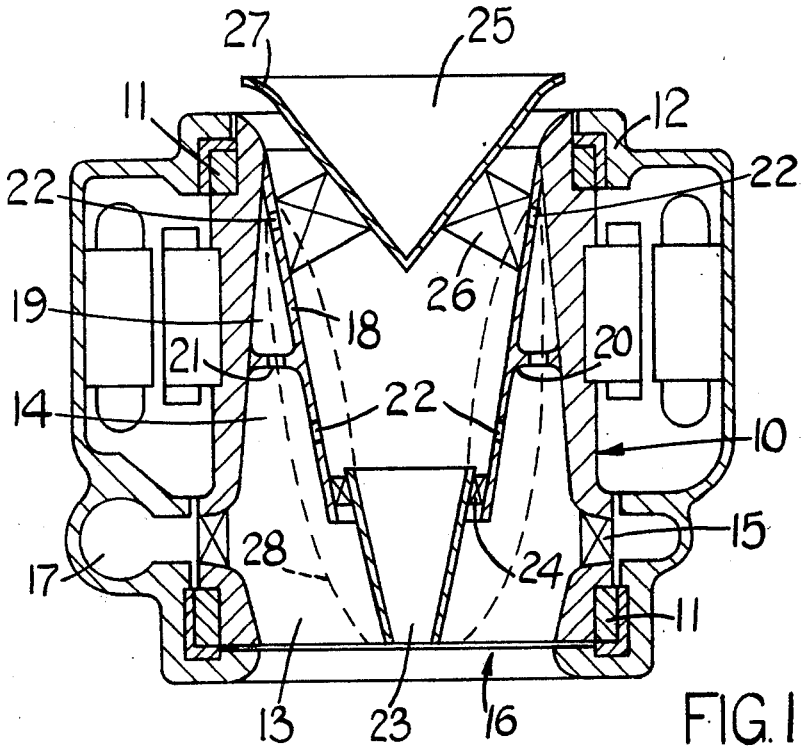

The pump shown in FIG. 1 has a rotor 10 forming part of an electric induction motor and mounted in bearings 11 in a stator 12 which also forms part of the induction motor. The rotor 10 includes a pair of axially aligned frusto-conical chambers 13, 14 having a centrifugal impeller arrangement 15 therebetween, the larger diameters of the chambers 13, 14 lying adjacent the impeller arrangement 15. The smaller diameter of chamber 13 defines an inlet 16 for the pump. A volute passage 17 within the stator 12 is aligned with the impeller arrangement 15 and communicates with an outlet (not shown) for the pump.

A first hollow frusto-conical member 18 having a through passage is mounted coaxially within the chamber 14 so as to define an annular space 19 within the chamber 14. The member 18 has its smaller diameter adjacent the impeller arrangement 15 and its larger diameter sealingly engaged with the smaller diameter of chamber 14. The member 18 is additionally secured within the chamber 14 by webs 20 formed with holes 21. Holes 22 extend through the walls of the member 18.

A second frusto-conical member 23 is mounted coaxially substantially within the chamber 13 by means of vanes 24 which engage the member 18, the larger diameter of the member 23 lying within the smaller diameter of the member 18. A conical deflector 25 is mounted on vanes 26 within the member 18. The apex of the deflector 25 points towards the pump inlet 16. The deflector 25 has a flared skirt 27 which extends axially beyond the end of the stator 12 remote from the inlet 16.

The pump is particularly adapted for use with a liquid fuel and in use is mounted with the inlet 16 adjacent the bottom of a fuel tank. Rotation of the rotor 10 causes fuel within the inlet 16 to be urged by centrifugal action along the walls of the chamber 13 to enter the impeller arrangement 15, whence it is discharged via the volute passage 17 to the pump outlet. Centrifugal action causes the fuel within inlet 16 to separate into an outer liquid zone which passes to the impeller arrangement 15, a central vapour zone and an intermediate zone, defined between lines 28, in which liquid and vapour are both present. The vapour in the central zone passes through the funnel 23 and member 18 to re-enter the tank.

The liquid-vapour mixture in the intermediate zone passes into the pump adjacent the wall of the member 18. Continuing centrifugal action urges liquid particles towards the wall of chamber 14, the slope of this wall subsequently urging the liquid particles towards the impeller arrangement 15. Increase of pressure adjacent the wall of member 18 causes some of the vapour particles to condense from the mixture. Liquid particles within that portion of the intermediate zone within member 18 pass through the holes 22. Vapour particles within the annular space 19 are displaced by the liquid particles entering the space 19 and pass through the holes 22 to the inside of member 18. There is thus a transference of liquid and vapour across the wall of member 18, and this transference is substantially complete by the time the intermediate zone of liquid and vapour has reached the uppermost of the holes 22. The amount of liquid fuel discharged from the upper end of the pump is thus considerably reduced, substantially all the work done on the liquid being directed to discharging the liquid from the pump outlet. The efficiency of the pump is thereby increased. The funnel 23 serves to contain the central vapour zone, and effectively prevents vapour moving from this zone to the intermediate zone. The deflector 25 and vanes 26 co-operate with member 18 to form an additional centrifugal pump, by means of which vapour is forcibly expelled from the upper end of the pump, thereby substantially reducing back pressure on the vapour.

Figure 2:
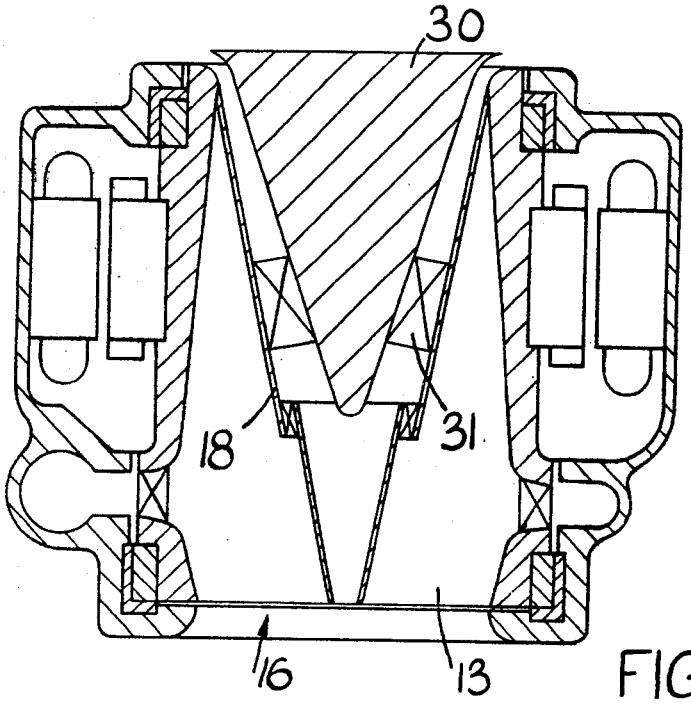

The pump of FIG. 2 is generally similar to that of FIG. 1. The member 18 has a conical deflector 30 which is solid and is mounted within the member 18 by vanes 31 which are closer to the inlet 16 of the pump than the corresponding vanes 26 of FIG. 1. The conical deflector 30 moreover extends further in the member 18 than the deflector 25 of FIG. 1. This arrangement enables the member 18 to be primed initially with a liquid/vapour mixture when the fuel level in the associated tank is lower than that at which the pump of FIG. 1 can successfully be primed.

Figure 3:
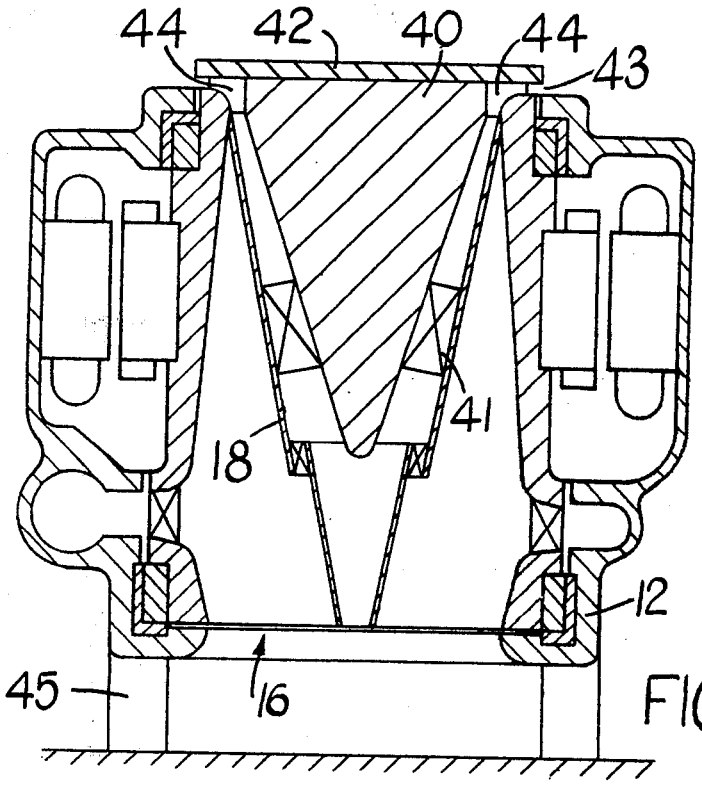

The pump shown in FIG. 3 is also a variant of that shown in FIG. 2, including a solid conical deflector 40 extending almost to the inlet end of the member 18 and mounted in member 18 by vanes 41. Additional vanes 44 extend radially between the larger diameters of the member 18 and the deflector 40, and provide additional impellers which further assist expulsion of vapour from the upper end of the pump. A plate 42 forming part of the deflector 40 defines a narrow outlet 43 for vapour discharged from the pump. Vanes 45 are secured to the inlet of the stator 12 so that, in use, fuel enters the inlet 16 tangentially. It will be understood that similar vanes may be provided at the inlets of any of the pumps previously described.

We claim:

1. A pump comprising a rotor defining a pair of axially aligned frusto-conical chambers and a centrifucal impeller arrangement between said chambers, said impeller arrangement comprising means for urging a fluid radially outwardly of the axes of said frusto-conical chambers, the larger diameter of each chamber being adjacent the impeller arrangement and the smaller diameter of one of the chambers defining an inlet for the pump, a first hollow frusto-conical member having a through passage and being mounted coaxially within the other of the chambers so as to define an annular-section space therein, the smaller diameter of said first member being directed towards the impeller arrangement and the larger diameter of said first member engaging the smaller diameter of said other chamber, a stator surrounding said rotor, said rotor being freely rotatable within said stator about the axes of said frusto-conical chambers, a passage within the stator communicating with said impeller arrangement and with an outlet for the pump, a deflector having a conical surface and being mounted within said first member so as to define an annular space between said deflector and said first member, the apex of said conical surface being directed towards the pump inlet and the larger end of said deflector extending axially beyond the end of the stator remote from said inlet, the larger end of said deflector including a portion extending radially outwardly of said conical surface, a first group of a plurality of vanes extending between the larger diameter ends of the first member and the deflector, and a second group of a plurality of vanes extending between the first member and the deflector intermediate the ends thereof.

2. A pump as claimed in claim 1 which includes a second hollow frusto-conical member mounted coaxially within said one chamber the smaller diameter of said second member being directed towards the inlet and the larger diameter of said further member lying within the smaller diameter of the first member.

3. A pump as claimed in claim 2 which includes a plurality of vanes extending between said first and second members.

4. A pump as claimed in claim 1 in which the deflector extends within the first member for substantially the whole of the length thereof.

5. A pump as claimed in claim 4 which includes a plate secured to the base of said deflector and defining, in combination with the smaller diameter of said other chamber an outlet for the space between the deflector and the said first member.

6. A pump as claimed in claim 1 in which the said passage in the stator is a volute.

7. A pump as claimed in claim 1 in which the rotor and stator respectively form parts of a rotor and stator of an electric induction motor.

* * * * *